United States Patent [19]

Röck et al.

[11] 4,165,907

[45] Aug. 28, 1979

[54] PULL-OUT GUIDE FOR DRAWERS OR THE LIKE

[75] Inventors: Erich Röck, Höchst; Bernhard Mages, Dornbirn, both of Austria

[73] Assignee: Julius Blum Gesellschaft m.b.H., Höchst, Austria

[21] Appl. No.: 857,195

[22] Filed: Dec. 2, 1977

[30] Foreign Application Priority Data

Dec. 10, 1976 [AT] Austria ..... 9177/76

[51] Int. Cl.[2] ..... F16C 29/04

[52] U.S. Cl. ..... 308/3.8; 312/341 R; 312/348

[58] Field of Search ..... 308/3.6, 3.8; 312/348, 312/341 R, 339, 340; 49/452, 125

[56] References Cited

U.S. PATENT DOCUMENTS

| | | | |
|---|---|---|---|
| 2,928,696 | 3/1960 | Hiers | 308/3.8 |
| 3,746,418 | 7/1973 | Barber | 312/348 |

FOREIGN PATENT DOCUMENTS

| | | | |
|---|---|---|---|
| 2513742 | 10/1975 | Fed. Rep. of Germany | 312/341 R |
| 2462141 | 2/1976 | Fed. Rep. of Germany | 312/341 R |
| 2302444 | 9/1976 | France | 308/3.8 |
| 644062 | 8/1962 | Italy | 308/3.8 |

*Primary Examiner*—Charles E. Frankfort

*Attorney, Agent, or Firm*—Wenderoth, Lind & Ponack

[57] ABSTRACT

A pull-out guide for drawers and the like includes a stop that makes it possible to correct the position of the drawers. The stop is located at the front end of the rail attached to the drawer or to the rear end of the rail attached to the cabinet. An arrangement for tilting the stop is provided.

10 Claims, 9 Drawing Figures

PULL-OUT GUIDE FOR DRAWERS OR THE LIKE

BACKGROUND OF THE INVENTION

1. Field of the Invention

The invention relates to a pull-out guide for drawers or the like with one supporting rail and one pull-out rail on either side of the drawer and rollers situated between the pull-out rail and the supporting rail, such rollers being mounted in a roller-carrier.

2. Description of the Prior Art

In modern furniture production such pull-out guides are widely used with drawers and the like and particularly in kitchen furniture production.

In general, the purpose of such guides is to facilitate the moving of the drawers.

Drawer guides according to the prior art are generally fitted with rollers, but also with slides preferably of plastic, or with a combination of rollers and slides, and also with freely moving balls.

Particularly easy running or movement has been achieved by using so-called roller-carriers in which the rollers or balls are mounted in such a way that they run freely between the supporting rail and the pull-out rail.

The object of the present invention is to make an exact vertical alignment of the drawer possible, and thus also an alignment of the front panel of the drawer. In addition, a slight tilting of the drawer when pushed into the cabinet should also be prevented.

SUMMARY OF THE INVENTION

In accordance with the invention, these objects are achieved by providing a turnable stop for the running flange of the pull-out rail or for the supporting flange of the supporting rail. The stop is disposed on one end of the supporting rail or the pull-out rail, the stop having a stopping surface for the oncoming horizontal flange of the corresponding other rail.

It is furthermore provided that the stop is fork-shaped with two prongs, the stopping surface disposed on the lower prong forming a V-shape with an opposite surface of the upper prong.

Thus, a safe positioning of the pull-out rail is achieved when it is pushed into the cabinet, and this can still be improved when the inner surfaces of the prongs of the stop have at their inner ends portions that are at least approximately parallel to each other and form a supporting slot for the horizontal flange of the corresponding rail when it is pushed between the prongs of the fork-like stop.

The stop is advantageously injection-moulded of plastic.

An embodiment of the invention provides a circular rotatable disk having an eccentric curved path which is formed by a recess and in which a bolt or the like of the stop is guided.

It is advantageously provided that one end of the approximately semicircular curved path is positioned approximately in the center of the disk and the other end near the periphery of the disk.

In this way it is possible to have three significant positions of the disk and the stop. If the disk is turned in such a way that both ends of the curved path are positioned approximately on one horizontal line and that the center point of the curve is the highest point of the curved path, the stop is in its "O"-position, its bolt being positioned approximately in the center of the curved path. Adjustment in the upward and downward direction is possible. By turning the disk with a screw-driver in such a way that the two ends of the curved path are positioned approximately in one vertical line and that the bolt of the stop is positioned on the upper end of the curved path lying near to the periphery of the disk, the stop is placed in its highest position. By turning the disk in the opposite direction so that the bolt of the stop comes to rest at the end of the curved path lying near the center of the disk, the stop is placed in its lowest position.

A further embodiment of the invention provides that the rail supporting the stop has a U-shaped profile, with the diameter of the circular disk corresponding to the width of the U-shaped profile.

In order to have the disk safely supported an embodiment of the invention provides that the ends of the flanges are bent to form two strips, one strip resting on the periphery of the disk the other strip resting laterally on the disk, the strips forming together with the vertical flange of the rail a holding device for the disk.

In order to facilitate the insertion of an adjusting tool, e.g. a screw-driver, an embodiment of the invention provides that the disk has an axially protruding part that is provided with a slot or the like in which a screw-driver can be inserted. This protruding part can also be a guide or support for the stop if, for example, a projection or edge of the stop rests on such part.

BRIEF DESCRIPTION OF THE DRAWINGS

In the following an embodiment of the invention is described in detail with reference to the figures of the accompanying drawings, in which.

DESCRIPTION OF THE PREFERRED EMBODIMENTS

Figure 1:
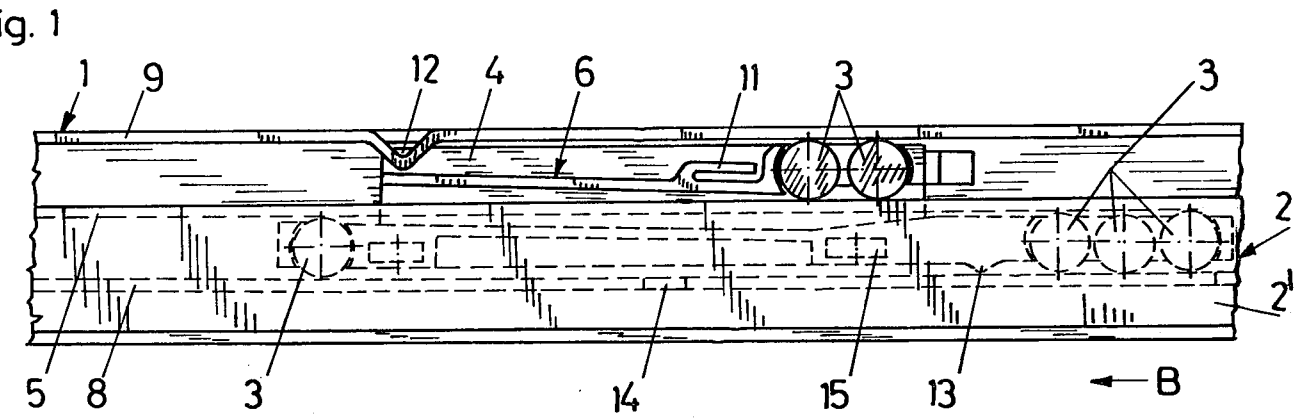
FIG. 1 is a schematic side view of the pull-out guide in accordance with the invention.

The pull-out guide in accordance with the invention consists of a supporting rail 1 mounted on the body of a piece of furniture, for example a cabinet, which rail has a U-shaped profile, for example, and can be inserted into a corresponding groove in the side wall of the piece of furniture. In addition, the pull-out guide comprises a guide rail 2 fixed to the side of a drawer of the piece of furniture.

The body and drawer of the piece of furniture are not illustrated in the drawings, as anybody skilled in the art is familiar with the way of mounting the guide rail to the piece of furniture.

As can be seen in the drawings, a roller-carrier 6 is disposed in the U-shaped profile of the supporting rail 1. The carrier 6 is advantageously injection-moulded of plastic material. As can be seen in FIG. 1, six rollers 3 are mounted in the roller-carrier 6 in such a way that four rollers 3 run on the supporting or lower flange 8 of the supporting rail 1, while two rollers 3 are located in the area of the upper horizontal flange 9 of the supporting rail 1. The grouping of the rollers 3 depends on the distribution of the load and the resulting forces at individual points.

When the drawer is pushed in, the running or middle flange 5 of the guide rail 2 is inserted into the roller-carrier 6 in such a way that the running flange 5 rests on the two lower roller groups, while the third, and in respect to the depth of the piece of furniture, middle roller group rests on the top of the running flange 5.

In this way the guide rail 2 and thereby the drawer are held safe against tilting in the supporting rail 1. If the drawer and thus the guide rail 2 are pulled out in the direction of arrow B from the piece of furniture the roller-carrier 6 moves with them.

A flap 11 which is injection-moulded in one piece with the roller-carrier 6 will then become located below a projection 12 of the supporting rail 1.

This projection 12 is situated at the free edge of the upper horizontal flange 9 of the supporting rail 1, and since projection 12 does not extend over the entire breadth of the horizontal flange 9, it also forms a lateral safeguard or retainer for the roller-carrier 6. More particularly, when the drawer is fully pulled out of the cabinet, the wall 4 of the roller-carrier 6 is pushed between the projection 12 and the vertical flange or web of the supporting rail. Thus, roller-carrier 6 is laterally retained within rail 1.

When the drawer is in such foremost position, the flap 11 is wedged downwardly by projection 12 and thus presses the roller-carrier 6 downwardly, such that peg 13 is pressed into the hole 14 of the flange 8.

Through this arrangement the roller-carrier 6 remains locked in the supporting rail 1 and is prevented from falling out while the lateral guidance of the drawer is missing.

In addition, to ensure silent running the roller-carrier 6 is provided with lateral compensating rollers 15 which turn about axes normally aligned to the axes of the supporting rollers 3.

The compensating rollers 15 run on the above mentioned vertical flange of the supporting rail 1 and on the vertical flange or wall 2' of the pull-out rail 2.

Adjacent an end of one of the rails there is provided a stop 7 which is made of plastic. This stop 7 could be located on the rear end of the supporting rail 1, but it is more practically mounted on the front end of the pull-out rail 2. Stop 7 is fork-shaped and has an open mouth defined by upper and lower prongs 17 and 16.

In the drawings, the stop 7 is shown as being mounted on the front or outer end of the pull-out rail 2, such that when the drawer is pushed into the closed position thereof, the front end of the lower flange 8 of the supporting rail 1 will be positioned between the prongs of the stop 7, in a manner to be described in more detail below. However, it is to be understood that the stop could be mounted on the inner or rear end of the supporting rail 1, such that when the drawer is pushed into the closed position thereof, the rear or inner end of the upper flange 5 of the pull-out rail 2 would be positioned between the prongs of the stop 7.

With the drawer closed, the front end of the horizontal flange 8 of the supporting rail 1 rests on the stopping surface 10 of the lower prong 16 of the fork-shaped stop 7. The flange 8 then is relatively vertically positioned and held in the stop 7 between the lower prong 16 and the upper prong 17.

Figure 8:
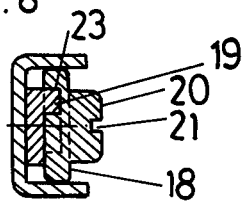
FIG. 8 is a section along line AB of FIG. 3.
Figure 9:
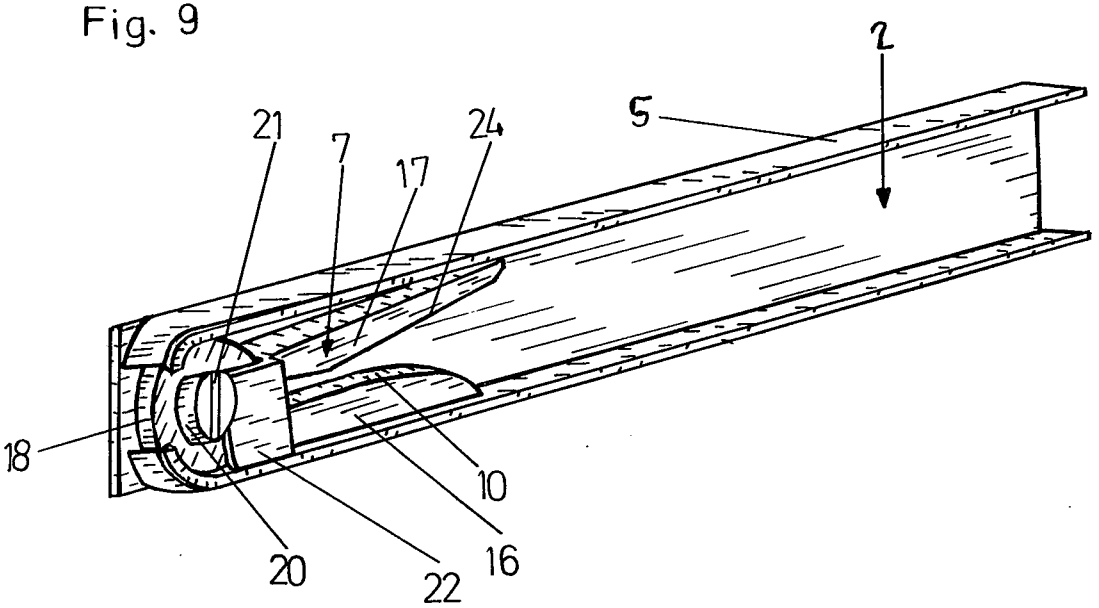
FIG. 9 is a perspective view of the pull-out guide.

A disk 18 is positioned and held at the outer or front end of the pull-out rail 2. Disk 18 has on one surface thereof an eccentric recess 23 forming a curved path for a bolt or pin 19 extending from stop 7, as shown in FIG. 8.

By turning the disk 18, the bolt 19 of the stop 7 which protrudes into the curved recess 23 is moved with regard to height (see FIGS. 5, 6, 7), and the stop 7 is turned about a center of rotation X, the center of rotation X, however, slightly changing its position in the direction of double arrow Y.

At the center of its other surface, the disk 18 is provided with an axially protruding part 20 having a slot 21 for receiving a screw-driver. Part 20 also supports and guides a projection 22 of stop 7 which rests against part 20.

Figure 2:
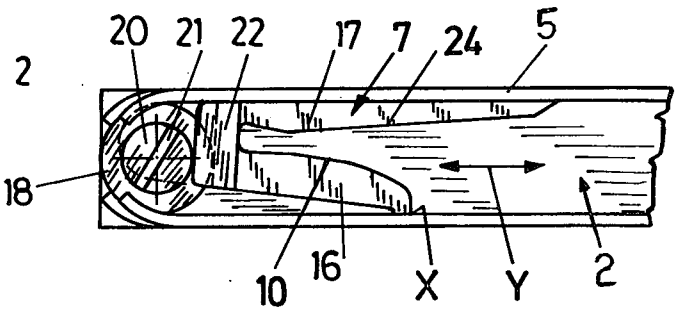
FIGS. 2, 3 and 4 are side views of the pull-out guide in accordance with the invention.
Figure 3:
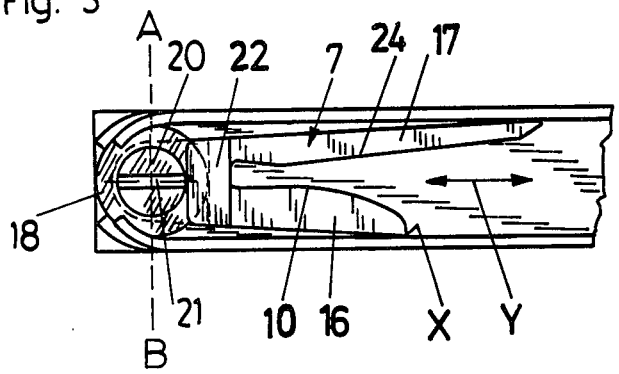
Figure 4:
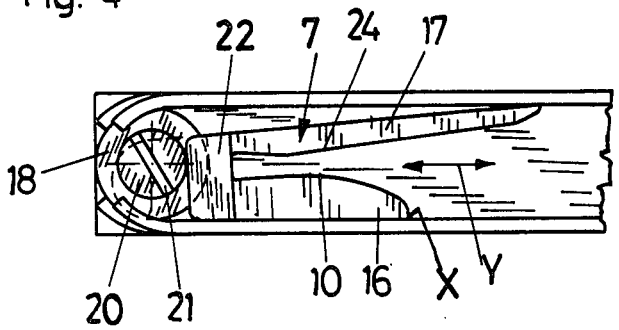
Figure 5:
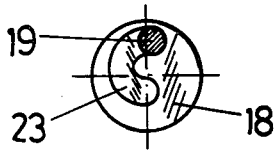
FIGS. 5, 6 and 7 are detailed side views showing different positions of the disk and the bolt of the stop.
Figure 6:
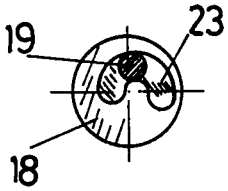
Figure 7:
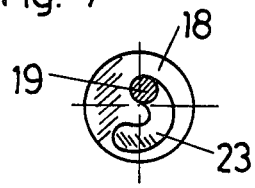

By turning the disk 18 between the positions shown in FIGS. 5–7, the stop 7 will be moved to the positions shown in FIGS. 2–4, respectively, and the position of the pushed-in drawer with respect to the height of the piece of furniture will accordingly be changed.

In order to improve the safe support of the disk 18 and the stop 7 in the rail in which they are mounted, the ends of the respective horizontal flanges of the rails are bent and formed in such a way that a part of them rests laterally on the disk 18 (FIGS. 2,3,4).

We claim:

1. In a drawer pull-out guide for use on opposite sides of a drawer which may be pulled out and pushed into an article of furniture, said guide including an elongated supporting rail adapted to be attached to a body of an article of furniture, said supporting rail having a U-shaped profile including upper and lower substantially horizontally extending flanges and a substantially vertically extending web joining said upper and lower flanges; an elongated pull-out rail adapted to be attached to a drawer of the article of furniture, said pull-out rail including a substantially horizontally extending middle flange positioned between said upper and lower flanges of said supporting rail and a substantially vertically extending wall depending downwardly from said middle flange; a roller carrier longitudinally movably positioned within said supporting rail and supporting three longitudinally spaced groups of rollers, each said group of rollers including at least one roller, first and second of said groups of rollers being positioned between said lower flange of said supporting rail and said middle flange of said pull-out rail, a third of said groups of rollers being positioned between said middle flange of said pull-out rail and said upper flange of said supporting rail, and said third group being longitudinally located between said first and second groups; and said pull-out rail and said supporting rail each having opposite rear and front ends, said pull-out rail being longitudinally slidable with respect to said supporting rail between a drawer pushed-in position whereat said rear and front ends of said pull-out rail are positioned adjacent said rear and front ends, respectively, of said supporting rail, and a drawer pulled-out positioned whereat said rear and front ends of said pull-out rail are longitudinally outwardly spaced from said rear and front ends, respectively, of said supporting rail; the improvement comprising:

stop means, supported adjacent one of said front end of said pull-out rail and said rear end of said supporting rail, for receiving and vertically supporting one of said front end of said lower flange of said supporting rail and said rear end of said middle flange of said pull-out rail, respectively, when said pull-out rail is in said drawer pushed-in position, said stop means having a fork-shaped configuration including an open mouth defined by upper and lower prongs, said mouth facing said one of said front end of said lower flange of said supporting rail and said rear end of said middle flange of said pull-out rail when said pull-out rail is being moved toward said drawer pushed-in position; and means, connected to said stop means, for selectively adjusting the relative vertical height of said stop means, and for thereby selectively adjusting the relative vertical alignment of said pull-out rail with respect to said supporting rail when said pull-out rail is in said drawer pushed-in position.

2. The improvement claimed in claim 1, wherein said stop means is supported at said front end of said pull-out rail, and said front end of said lower flange of said supporting rail is positioned between said upper and lower prongs when said pull-out rail is in said drawer pushed-in position.

3. The improvement claimed in claim 2, wherein, when said pull-out rail is in said drawer pushed-in position, said front end of said lower flange of said supporting rail rests on an upper surface of said lower prong.

4. The improvement claimed in claim 2, wherein said adjusting means comprises a circular rotatable disk positioned in said front end of said pull-out rail, said disk having in a first surface thereof an eccentric curved recess forming a curved path, and a pin rigid with said stop means extending into said recess, whereby rotation of said disk about the axis thereof will cause eccentric movement of said pin with respect to said disk axis and thereby relative vertical movement of said stop means.

5. The improvement claimed in claim 4, wherein said recess has an approximately semicircular shape with a first end positioned adjacent the center of the disk and a second end positioned adjacent the periphery of the disk.

6. The improvement claimed in claim 4, wherein said pull-out rail has a U-shaped profile including said middle flange, said vertically extending wall and a bottom horizontally extending flange, the width between said middle and bottom flanges being approximately equal to the diameter of said disk.

7. The improvement claimed in claim 6, wherein the front ends of said middle and bottom flanges are formed to extend partially around the periphery of said disk and to extend partially across a second surfaces of said disk, thereby supporting said disk.

8. The improvement claimed in claim 4, wherein a second surface of said disk has extending therefrom a protrusion having thereon means for facilitating rotation of said disk.

9. The improvement claimed in claim 8, wherein said stop means has extending therefrom a projection which contacts said protrusion.

10. The improvement claimed in claim 2, wherein an upper surface of said lower prong and a lower surface of said upper prong extend substantially parallel.

* * * * *